US010155574B1

(12) United States Patent
Tsarev et al.

(10) Patent No.: US 10,155,574 B1
(45) Date of Patent: Dec. 18, 2018

(54) UNDERWATER VESSEL ASSEMBLY HAVING TOW POINT ADAPTER PLATES FOR PERFORMANCE OPTIMIZATION

(71) Applicant: The United States of America as Represented by the Secretary of the Navy, Washington, DC (US)

(72) Inventors: Alexander Tsarev, North Potomac, MD (US); Christopher Nunes, Arlington, VA (US); Dana Colegrove, Fairfax, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/976,629

(22) Filed: May 10, 2018

Related U.S. Application Data

(60) Provisional application No. 62/504,424, filed on May 10, 2017.

(51) Int. Cl.
*B63G 8/42* (2006.01)
*B63G 8/14* (2006.01)

(52) U.S. Cl.
CPC ..... *B63G 8/42* (2013.01); *B63G 8/14* (2013.01)

(58) Field of Classification Search
CPC ..... B63G 8/42; B63G 8/14
See application file for complete search history.

(56) References Cited

U.S. PATENT DOCUMENTS

| | | | | |
|---|---|---|---|---|
| 4,350,111 | A * | 9/1982 | Boyce, II | B63G 8/42 114/245 |
| 5,752,460 | A * | 5/1998 | Buffman | B63B 21/66 114/244 |
| 2016/0009344 | A1* | 1/2016 | Jourdan | B63B 21/66 114/321 |
| 2016/0137270 | A1* | 5/2016 | Sturges | B63B 21/04 114/253 |
| 2016/0306065 | A1* | 10/2016 | Steinsland | G01V 3/15 |

* cited by examiner

*Primary Examiner* — Stephen P Avila
(74) *Attorney, Agent, or Firm* — Dave Ghatt

(57) ABSTRACT

The invention is directed to a towing adaptation system for optimizing the pitch attitude, hydrodynamic lift and drag forces on an underwater acoustic vessel. The towing adaptation system an underwater vessel to which is attached a first adapter plate and a second adapter plate, with each adapter plate having a plurality of vertically displaced staged attachment points. Corresponding attachment points of the first and second adapter plates form attachment pairs, with each attachment pair calibrated to provide a desired cable angle, hydrodynamic lift, and drag force, at a predetermined steady-state speed, for optimizing performance.

7 Claims, 6 Drawing Sheets

UNDERWATER VESSEL ASSEMBLY HAVING TOW POINT ADAPTER PLATES FOR PERFORMANCE OPTIMIZATION

CROSS-REFERENCE TO RELATED APPLICATIONS

This application claims the benefit of U.S. Provisional Application No. 62/504,424 filed May 10, 2017, which is incorporated herein by reference.

STATEMENT OF GOVERNMENT INTEREST

The following description was made in the performance of official duties by employees and/or contractors of the Department of the Navy, and, thus the claimed invention may be manufactured, used, licensed by or for the United States Government for governmental purposes without the payment of any royalties thereon.

TECHNICAL FIELD

The invention is directed to a towing adaptation system for optimizing the pitch attitude, hydrodynamic lift and drag forces on an underwater acoustic vessel.

BACKGROUND

Underwater acoustic vessels are used to perform maritime tasks. The effectiveness of these vessels can be optimized according to the depth at which they operate. Therefore, the unit must be towed within a specified depth tolerance in order to perform effectively. Typically, underwater acoustic vessels are towed from on or above the water, via a ship or an aircraft, for example. It is desired to have an assembly that is attachable to the underwater acoustic vessel for optimizing the pitch attitude, hydrodynamic lift and drag forces on an underwater acoustic vessel.

SUMMARY

In one aspect, the invention is an underwater vessel assembly for optimizing the pitch attitude, hydrodynamic lift and drag forces. In this aspect, the invention includes an underwater acoustic vessel having a substantially cylindrical shape, and a forward end and an aft end, a starboard portion and a portside portion. The underwater vessel assembly also includes an elongated streamlined float, above and attached to the underwater acoustic vessel. The elongated streamlined float has a nose portion and a tail portion, so that the nose portion is above the forward end of the underwater acoustic vessel and the tail portion is above the aft end of the underwater acoustic vessel.

The underwater acoustic vessel assembly also includes a first adapter plate attached to the portside portion at the forward end of the underwater acoustic vessel, and a second adapter plate attached at the starboard portion at the forward end of the underwater acoustic vessel. In this aspect, the assembly also includes a tow bail having a first attachment end and a second attachment end. The first attachment end is attached to the first adapter plate and the second attachment end is attached to the second adapter plate. Each of the first adapter plate and the second adapter plate includes a plurality of staged attachment points. Additionally, each staged attachment point on the first adapter plate corresponds to a staged attachment point on the second adapter plate, forming a series of attachment pairs. Each attachment pair is attachable to the first and second ends of the tow bail. In this aspect, each attachment pair is calibrated to provide a desired cable angle, hydrodynamic lift, and drag force, at a predetermined steady-state speed, for optimizing performance.

BRIEF DESCRIPTION OF THE DRAWINGS

Other features will be apparent from the description, the drawings, and the claims.

DETAILED DESCRIPTION

Figure 1A:
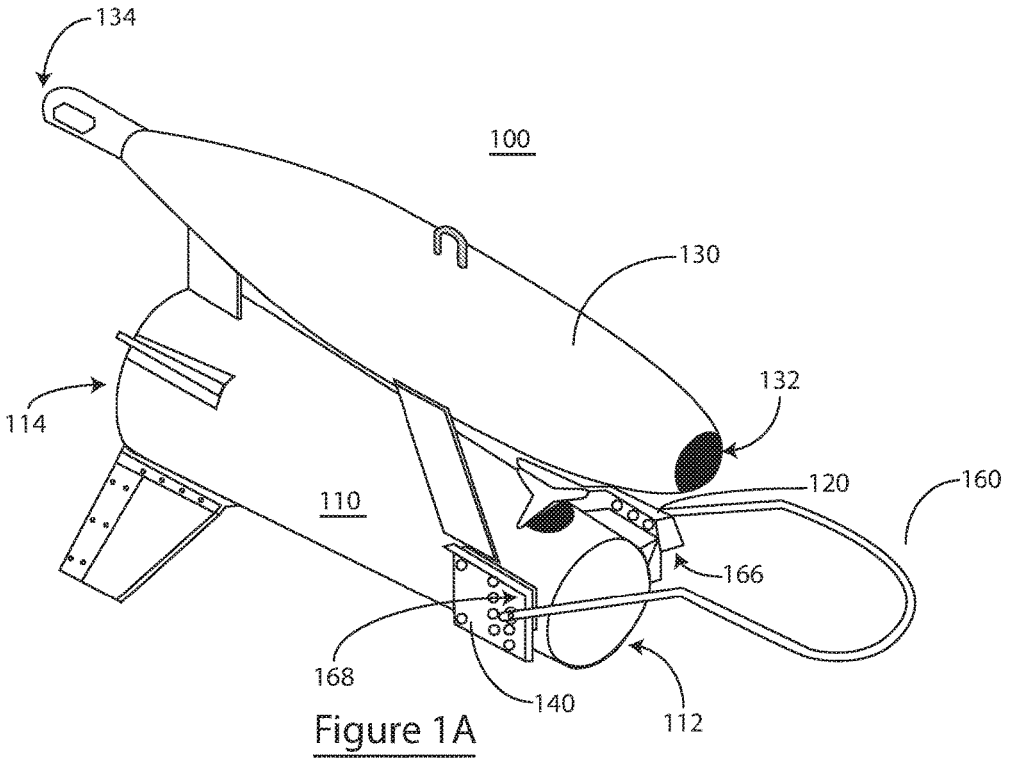
FIG. 1A is a perspective illustration of an underwater vessel assembly for optimizing the pitch attitude, according to an embodiment of the invention.
Figure 1B:
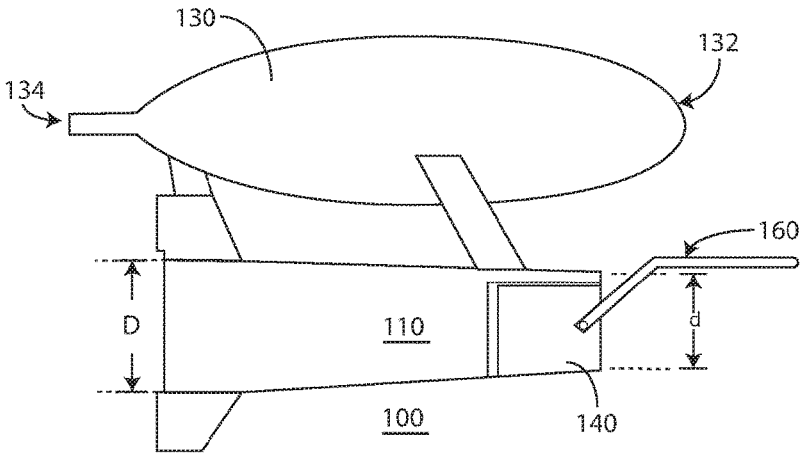
FIG. 1B is a side view of the underwater vessel assembly for optimizing the pitch attitude, according to an embodiment of the invention.

FIG. 1A is a perspective illustration of an underwater vessel assembly 100 for optimizing the pitch attitude, according to an embodiment of the invention. FIG. 1B is a side view of the underwater vessel assembly 100 for optimizing the pitch attitude, according to an embodiment of the invention. FIGS. 1A and 1B show an underwater acoustic vessel 110. As shown in FIG. 1A, the vessel 110 is elongated and is substantially cylindrical, having circular diameters along its length. FIGS. 1A and 1B show the vessel 110 having a forward end 112 and an aft end 114.

According to an embodiment of the invention, the diameter d of the vessel 110 at the forward end 112 is smaller than the diameter D at the aft end 114, with the diameters along the length of the vessel 110 increasing gradually from d at the forward end 112 to D at the aft end 114. The perspective view of FIG. 1A shows the vessel 110 being hollow and shell-like. FIG. 1A shows the vessel 110 having a starboard portion 116 and a portside portion 118.

FIGS. 1A and 1B show the underwater vessel assembly 100 also having an elongated streamlined float 130, which is attached to the underwater acoustic vessel 110. As shown in the perspective illustration, the elongated streamlined float 130 has a nose portion 132 and a tail portion 134. The nose portion 132 is above the forward end 112 of the underwater acoustic vessel 110 and the tail portion 134 is above the aft end 114 of the underwater acoustic vessel 110.

Figure 1C:
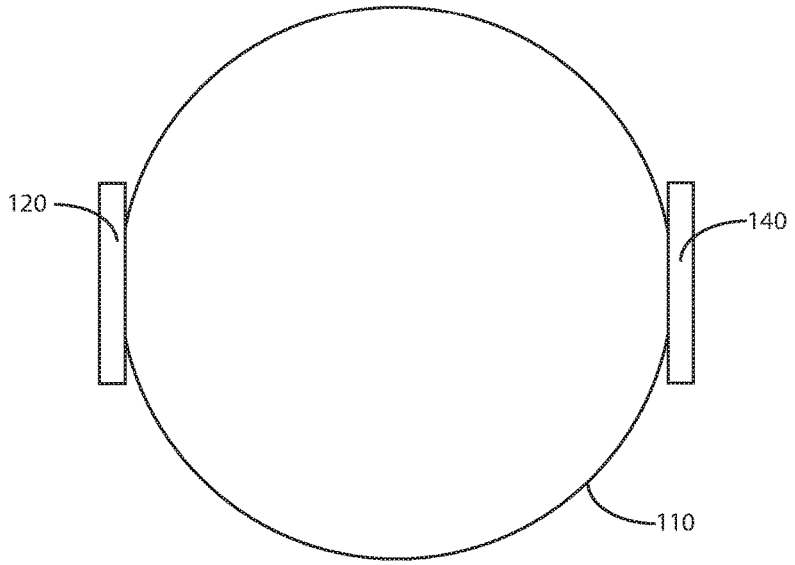
FIG. 1C is a sectional illustration showing how the adaptor plates are attached to the underwater acoustic vessel, according to an embodiment of the invention.
Figure 1D:
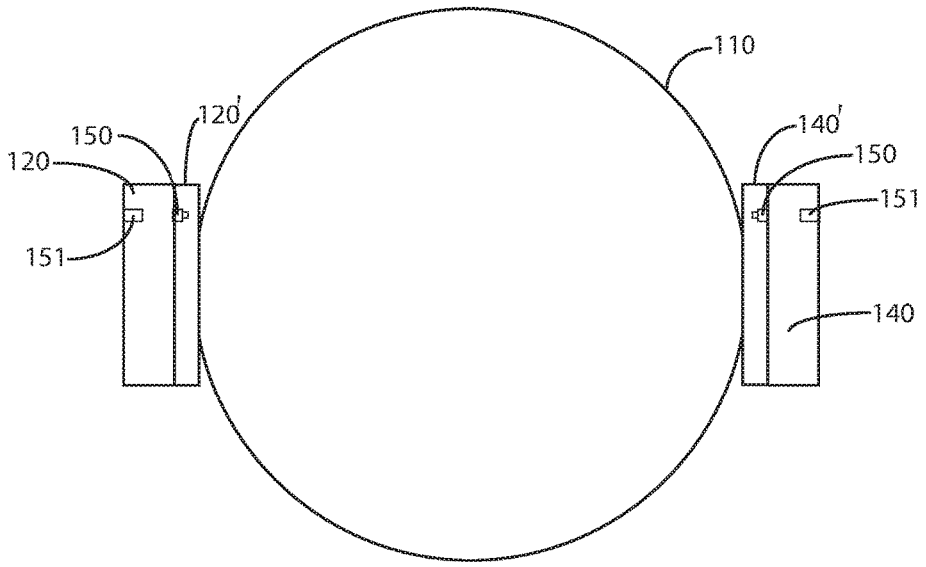
FIG. 1D is a sectional illustration showing how the adaptor plates are fitted to intervening plates on the underwater acoustic vessel, according to an embodiment of the invention.

FIG. 1A shows a first adapter plate 120 attached to the portside portion 118 at the forward end 112 of the underwater acoustic vessel 110. FIG. 1A also shows a second adapter plate 140 attached to the starboard portion 116 at the forward end 112 of the underwater acoustic vessel 110. FIGS. 1C and 1D are sectional illustrations showing how the plates 120 and 140 are attached to the underwater acoustic vessel 110. According to an embodiment of the invention, the underwater acoustic vessel 110. FIG. 1C shows the adapter plates 120 and 140 attached directly to the body of the vessel 110. FIG. 1D shows the plates 120 and 140 attached via intervening plates 120' and 140'. The FIG. 1D scenario may be applicable in situations which the underwater acoustic vessel 110 already has plates (120' and 140'), but the plates 120 and 140 are retrofitted onto the intervening plates (120' and 140'), to provide the benefits associated with having a series of vertically selectable tow points, as outlined below. It should be understood that the intervening attachment plates (120' and 140') may also include an attachment point 150 at a vertical height that is substantially the same as the attachment point 151.

Regarding the adapter plates 120 and 140, each plate includes a plurality of staged attachment points at which a tow bail 160 may be optionally attached. FIG. 1A shows the tow bail 160 having a first attachment end 166 and a second attachment end 168, the first attachment end 166 attached to the first plate 120 and the second attachment end 168 attached to the second plate 140. As outlined below, the attachment between the plates 120 and 140 and the tow bail 160 is made at predetermined staged attachment points for optimizing the pitch attitude, hydrodynamic lift and drag forces on an underwater acoustic vessel. In operation, a tow line (not shown) is attached to the tow bail 160 for towing the underwater vessel assembly 100. The tow line may be pulled by a tow ship or a tow aircraft, such as a helicopter or an airplane.

Figure 2A:
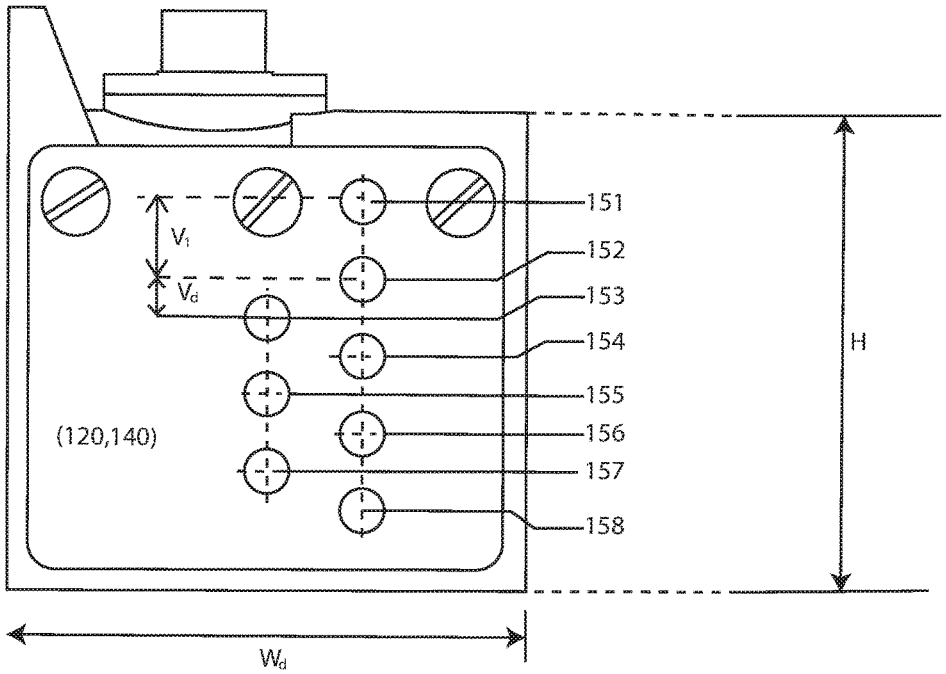
FIG. 2A is an exemplary illustration of a plate, according to an embodiment of the invention.

FIG. 2A is an exemplary illustration of an adapter plate (120, 140), according to an embodiment of the invention. The illustration of FIG. 2A is applicable to each of the first plate 120 and the second plate 140, as the plates are essentially mirror images of each other. FIG. 2A shows the plate having a plurality of staged attachment points at which a tow bail 160 may be optionally attached. FIG. 2A shows an uppermost reference attachment point 151, and subsequent vertically displaced attachment points (152, 153, 154, 155, 156, 157, and 158), with each successive attachment point effectively lowering the tow point, i.e., lowers the position at which the underwater vessel 110 is towed. It should be understood that there is special significance to having vertically displaced attachment points, as opposed to horizontal displacement, as horizontal displacement has been demonstrated to have almost no effect on the performance of the system.

According to an embodiment of the invention, each plate (120, 140) may have a height H of about 3 inches to about 8 inches, and may have a width $W_d$ of about 6 inches to about 10. Each plate may also have a thickness T (shown in FIG. 2B) of about 0.25 inches to about 0.5 inches. According to an embodiment of the invention, the reference attachment point 151 is vertically separated from attachment point 152 by about $V_t$, which is about 1.0 inch. The vertical separation $V_d$ between subsequent attachment points, i.e., between one attachment point and the next vertically displaced point is about 0.5 inches. Thus for example, attachment point 152 is vertically separated from attachment point 153 by about 0.5 inches, and attachment point 153 is vertically separated from attachment point 154 by about 0.5 inches. To accommodate this 0.5 inch vertical displacement between attachment points, attachment points (152, 153, 154, 155, 156, 157, and 158) are arranged in a zig-zag orientation. This zig zag arrangement is shown in FIG. 2A. According to an embodiment of the invention, the horizontal displacement $H_d$ between attachment points may be about 1.5 inches to about 3.0 inches. According to another embodiment of the invention, $V_d$ may be about 1.0 inches. It should be understood that the intervening attachment plates (120', 140') shown in the embodiment of FIG. 1D, may also include an attachment point 150 at a vertical height that is substantially the same as the attachment point 151. In this embodiment, the plates (120', 140') and respective attachment points 150 were attached to the underwater vessel 110 before the adapter plates (120, 140) were retrofitted thereon.

Figure 2B:
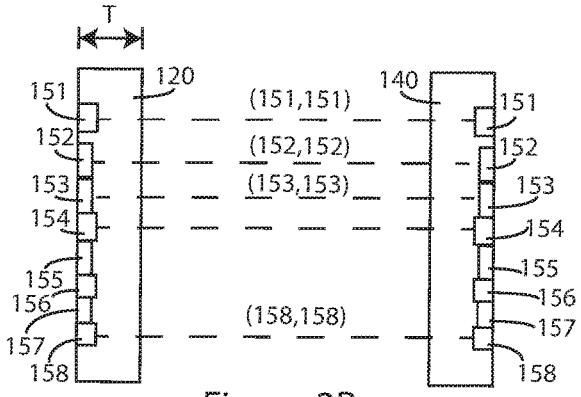
FIG. 2B is an exemplary front view from direction A (shown in FIG. 1A), showing the plates on either side of the underwater acoustic vessel, according to an embodiment of the invention.
Figure 3:
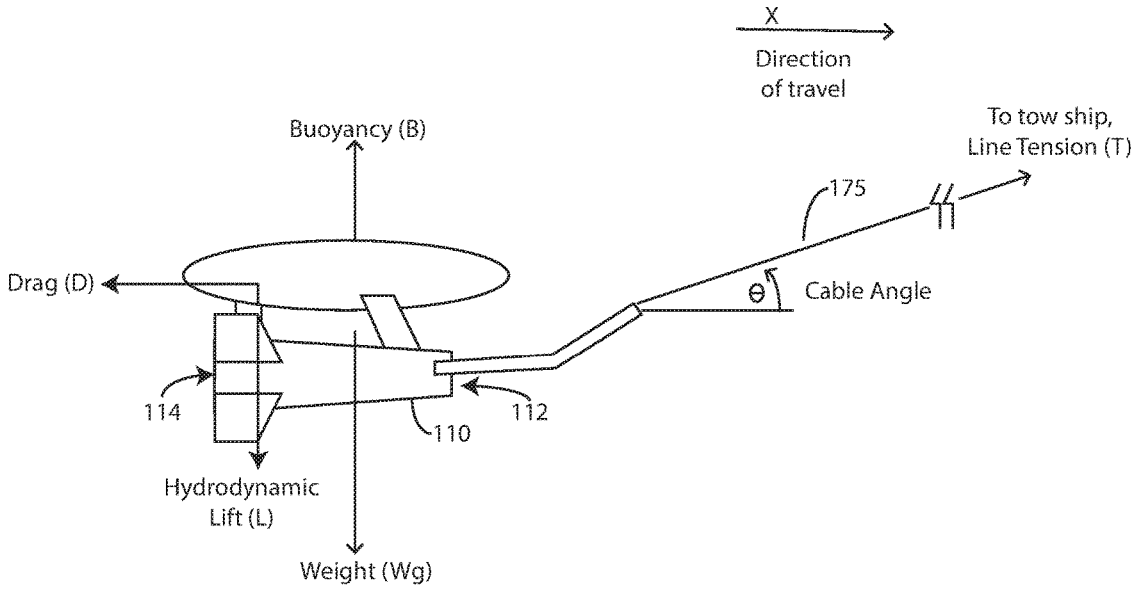
FIG. 3 is an exemplary force diagram, illustrating key forces and variables in play when the underwater vessel assembly is underway.

FIG. 2B is an exemplary explanatory front view from direction A (shown in FIG. 1A), showing the plates 120 and 140, as oriented on either side of the underwater acoustic vessel 110, according to an embodiment of the invention. The FIG. 2B illustration is applicable to both the embodiments of FIGS. 1C and ID, i.e., in embodiments with or without intervening plates 120' and 140'. FIG. 2B is meant to illustrate how the plates 120 and 140, on either side of the underwater acoustic vessel 110, pair-up to provide attachment pairs. As shown, each attachment point on the first plate 120 corresponds to a staged attachment point on the second plate 140, forming a series of attachment pairs. Each attachment pair on respective adapter plates 120 and 140 is attachable to the first and second ends (166, 168) of the tow bail 160. Thus for example, the attachment point 151 on the first adapter plate 120 and the corresponding attachment point 151 on the second adaptor plate 140, form an attachment pair. Similarly, the attachment point 156 on the first plate 120 and the corresponding attachment point 156 on the second plate 140, form another attachment pair. These and all the other attachment pairs (152, 152), (153, 153), (154, 154), (155, 155), (157, 157) and (158, 158) are possible attachment points for the first and second ends (166, 168) of the tow bail 160. As stated above, each successive attachment pair, (151, 151), (152, 152), (153, 153), (154, 154), (155, 155), (157, 157) and (158, 158) lowers the tow point. As outlined below with respect to FIGS. 3, 4A, and 4B, each attachment pair provides different known hydrodynamic measurements. FIG. 3 is an exemplary force diagram, illustrating key forces and variables in play when the underwater vessel assembly 100 is underway, travelling in direction X. These key variables include hydrodynamic lift L, buoyancy B, weight $W_g$, drag forces D, and cable angles θ. According to the invention, the attachment pairs outlined above are calibrated to provide desired hydrodynamic lifts L, drag forces D, and cable angles θ at predetermined tow speeds, which ultimately optimizes the performance of the underwater vessel assembly 100.

FIG. 3 shows the vessel 110 is elongated having a forward end 112 and an aft end 114. FIG. 3 also shows the elongated streamlined float 130, attached to and above the underwater acoustic vessel 110. The FIG. 3 illustration of the underwater vessel assembly 100 also includes the tow bail 160 attached at the forward end 112 of the vessel 110. FIG. 3 also shows a tow line/cable 175 attached to the tow bail 160 for towing the underwater vessel assembly 100. The tow line 175 may be pulled by a tow ship or a tow aircraft, such as a helicopter, an airplane, or the like.

FIG. 3 shows the underwater vessel assembly 100 traveling in a direction X. The vessel assembly 100 is being pulled by the tow line 175, which as stated above, may be attached to a towing ship or a towing aircraft. The tow line 175 is held taut under tension T at a cable angle θ, which is the inclination of the tow line with respect to the horizontal plane. FIG. 3 also shows the weight $W_g$ acting downwards through the center of gravity of the assembly, and the buoyancy B acting upwards, opposite to the weight. FIG. 3 also shows the drag D and the hydrodynamic lift L acting at the aft end of the assembly, with the drag and the lift acting perpendicularly to each other. In operation, the tow vessel travels at a prescribed speed. The tow cable 175 takes on a cable angle θ and tension T to provide the reaction forces to the drag D, lift L, weight $W_g$ and buoyancy B when steady-state speed is reached These variables relate to each other as shown below in equations (1) and (2):

$$T \sin \theta = (W - B) + L \quad (1)$$

$$T \cos \theta = D \quad (2)$$

The values of the variables shown in FIG. 3 are interrelated as outlined in equations (1) and (2). These values are also dependent on the location from which the tow bail 160 pulls the underwater acoustic vessel 110, as this affects the cable angle 9. As outlined above, the staged attachment points on the first and second plates (120, 140) form a series of attachment pairs, each attachment pair ultimately effecting a different cable angle θ. Thus, for example returning to the illustration of FIG. 2A, attachment pairs (152, 152) would effectuate a different cable angle cable angle θ, as compared to attachment pairs (155, 155), which vertically lower the tow point.

Regarding pitch attitude, and how it relates the above-outlined variables, for small angles of pitch, as the pitch of the vessel 110 goes further nose down, the cable angle θ increases. A change in vehicle pitch will result in changes to the lift L and drag D of the vehicle. Eventually, an optimized pitch angle is reached when the lift-to-drag ratio is a maximum value. Beyond this point if the pitch increases the lift-to-drag ratio will decrease and so will the cable angle θ. As outlined above, this invention optimizes pitch attitude, hydrodynamic lift L and drag forces D, and this is achieved by understanding the relationship between the variables as outlined in equations (1) and (2), and also by using selected attachment pairs to create the desired outcomes.

Figure 4A:
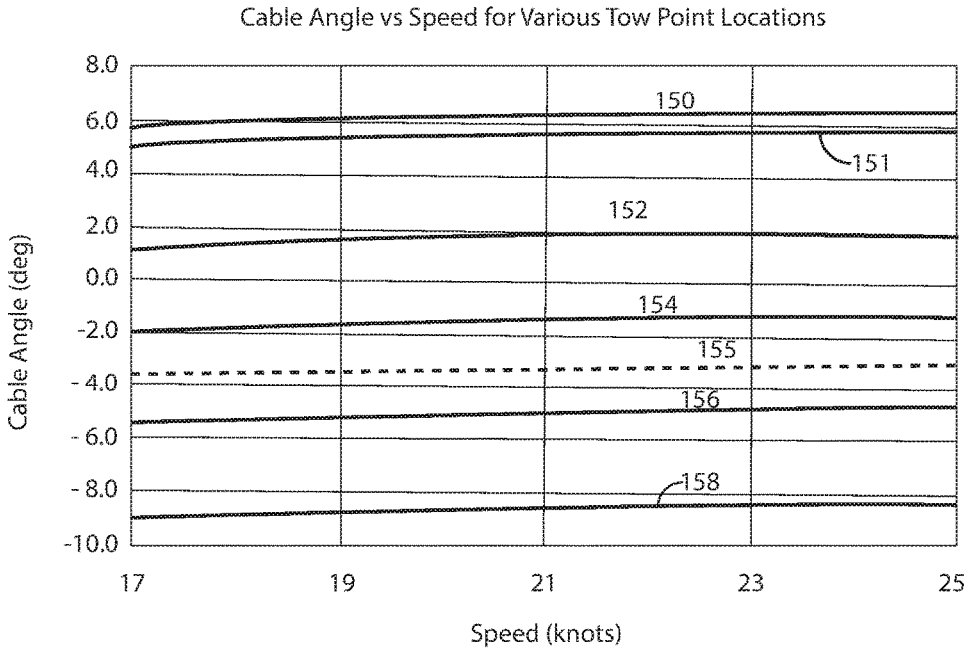
FIG. 4A is a chart showing the cable angles at different steady-state speeds, for different attachment points, according to an embodiment of the invention.

FIG. 4A is a chart showing the cable angles θ at different steady-state speeds V, for different attachment points, according to an embodiment of the invention. The steady state speeds V are reached when the assembly 100 is towed by a tow ship or a tow aircraft, or the like. As stated above, the attachment pairs outlined above are calibrated to provide desired hydrodynamic lifts L, drag forces D, and cable angles θ at predetermined tow speeds, which ultimately optimizes the performance of the underwater vessel assembly 100. The chart of FIG. 4A shows the different cable angles θ for different speeds, according to the specific attachment point or attachment pair.

Figure 4B:
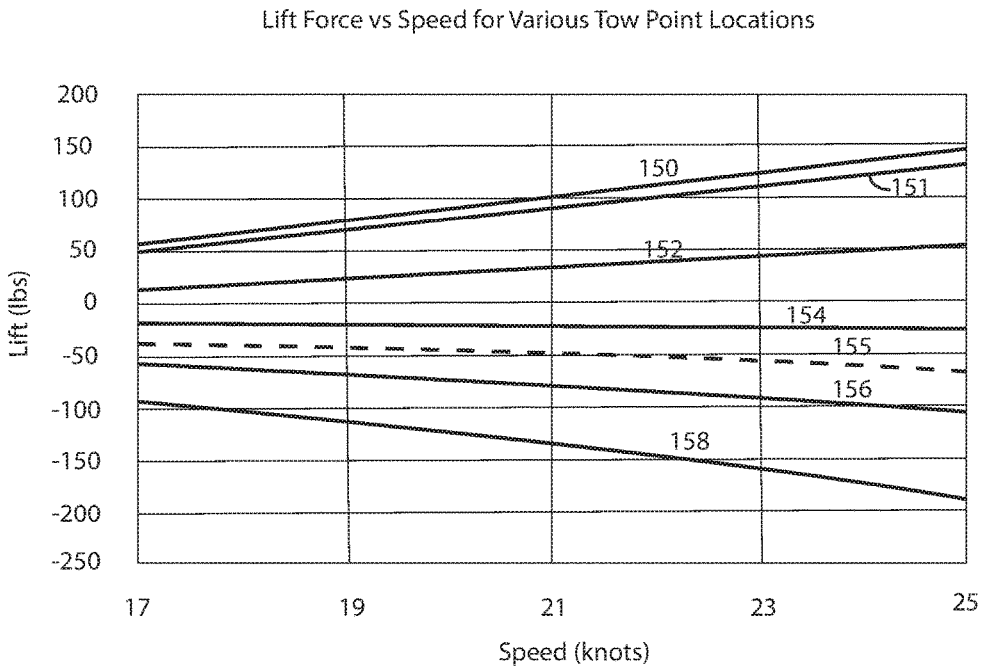
FIG. 4B is a chart showing the hydrodynamic lift force at different steady-state speeds, for different attachment points, according to an embodiment of the invention.

FIG. 4B is a chart showing the hydrodynamic lift force L at different steady-state speeds V, for different attachment points, according to an embodiment of the invention. The steady state speeds V are reached when the assembly 100 is towed by a tow ship or a tow aircraft, or the like. Again, the attachment pairs outlined above are calibrated to provide desired hydrodynamic lifts L, drag forces D, and cable angles θ at predetermined tow speeds, which ultimately optimizes the performance of the underwater vessel assembly 100. The chart of FIG. 4B shows the different hydrodynamic lift forces L for different speeds V, according to the specific attachment point or attachment pair.

Thus, both FIGS. 4A and 4B show the calibrated results for the different attachment pairs, according to the invention. FIGS. 4A and 4B show each of the column B attachment points 151, 152, 153, 154, 155, 156, 157, and 158, which are plotted showing the changes in cable angle θ and hydrodynamic lift L, respectively, with respect to steady-stage speed, which is based on the tow speed. FIG. 4A shows the uppermost attachment points/pairs 151 having the largest positive cable angles, at velocities ranging from 17 knots to 25 knots. Similarly, FIG. 4B shows the same attachment points/pairs 151 providing the highest positive lift values. For example at a speed of 21 knots, points 151 has a cable angle of about 5.7 degrees and a lift of about 85 lbs.

FIG. 4A shows the lowermost attachment points/pairs 158 having the smallest (largest negative) cable angles, at velocities ranging from 17 knots to 25 knots. Similarly, FIG. 4B shows the same lowermost points 158 providing the highest negative lift values. For example at a speed of 25 knots, lowermost point 158 has a cable angle of about −8.4 degrees and a lift of about −185 lbs.

FIGS. 4A and 4B show points/pairs 156 having a cable angle of about −4.8 degrees and a lift of about −100 lbs. at a speed of 25 knots. It should be noted that FIGS. 4A and 4B do not show the values for attachment points 157, but it understood that both the cable angles θ and the lift L values will fall between the values for attachment points 156 and 158. It should also be noted that FIGS. 4A and 4B show cable angles θ and the lift L values for points 150, which as outlined above, are attachment points on the intervening plates 120' and 140', and not on the adapter plates 120 and 140. As stated above, attachment points 150 are at substantially the same vertical level as attachment points 151. The cable angles θ and the lift L values for points 150 are included for reference and comparison purposes.

Generally speaking, FIGS. 4A and 4B show how the key forces and cable angles of the underwater vessel assembly 100 relate to the tow speed and ultimately steady-state speed. As stated above, an optimized pitch angle is reached when the lift-to-drag ratio is at a maximum. The relationship between lift L and drag D is defined by equations (1) and (2) stated above. FIGS. 4A and 4B also how these values are predicated upon which of the attachment points/attachment pairs, 151, 152, 153, 154, 155, 156, 157, and 158 are used to connect the tow bail 160.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. An underwater vessel assembly for optimizing the pitch attitude, hydrodynamic lift and drag forces comprising:

an underwater acoustic vessel having a substantially cylindrical shape, and a forward end and an aft end, a starboard portion and a portside portion;

an elongated streamlined float, above and attached to the underwater acoustic vessel, wherein the elongated streamlined float has a nose portion and a tail portion, so that the nose portion is above the forward end of the underwater acoustic vessel and the tail portion is above the aft end of the underwater acoustic vessel;

a first adapter plate attached at the portside portion at the forward end of the underwater acoustic vessel;

a second adapter plate attached at the starboard portion at the forward end of the underwater acoustic vessel; and a tow bail having a first attachment end and a second attachment end, the first attachment end attached to the first adapter plate and the second attachment end attached to the second adapter plate, wherein each of the first adapter plate and the second adapter plate includes a plurality of staged attachment points, with each staged attachment point on the first adapter plate corresponds to a staged attachment point on the second adapter plate, forming a series of attachment pairs, each attachment pair attachable to the first and second ends of the tow bail, wherein each attachment pair is calibrated to provide a desired cable angle, hydrodynamic lift, and drag force, at a predetermined steady-state speed, for optimizing performance.

2. The underwater vessel assembly of claim 1, wherein the plurality of staged attachment points on each of the first adapter plate and the second adapter plate, comprises a plurality of vertically displaced attachment points, wherein each successive attachment point lowers the position at which the underwater vessel is towed.

3. The underwater vessel assembly of claim 2, wherein the plurality of staged attachment points on each of the first adapter plate and the second adapter plate are vertically separated by at least 0.5 inches.

4. The underwater vessel assembly of claim 3, wherein each of the first adapter plate and the second adapter plate comprises eight attachment points forming eight attachment pairs, and wherein at steady-state speeds between 17 knots and 25 knots, an uppermost attachment pair of the eight attachment pairs provides the uppermost lift and cable angle values, and wherein a lowermost attachment pair of the eight attachment pairs provides lowermost lift and cable angle values.

5. The underwater vessel assembly of claim 4, wherein at a steady-state speed of 21 knots, the uppermost attachment pair provides a cable angle of about 5.7 degrees and a lift of about 85 lbs.

6. The underwater vessel assembly of claim 5, wherein at a steady-state speed of 25 knots, the lowermost attachment pair provides a cable angle of about −8.4 degrees and a lift of about −185 lbs.

7. The underwater vessel assembly of claim 6, further comprising a first intervening plate and a second intervening plate, wherein the first intervening plate is attached to the portside portion at the forward end of the underwater acoustic vessel, and the second intervening plate is attached at the starboard portion at the forward end of the underwater acoustic vessel, and wherein the first adapter plate is mounted to the first intervening plate, and wherein the second adapter plate is mounted to the second intervening plate.

* * * * *